US010123125B1

(12) United States Patent
Proni

(10) Patent No.: US 10,123,125 B1
(45) Date of Patent: Nov. 6, 2018

(54) LOUDSPEAKER WITH A FIELD REPLACEABLE MOVING ASSEMBLY AND METHOD OF ASSEMBLY

(71) Applicant: Lucio Proni, Weston, FL (US)

(72) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 0 days.

(21) Appl. No.: 15/585,310

(22) Filed: May 3, 2017

(51) Int. Cl.

| | |
|---|---|
| ***H04R 9/06*** | (2006.01) |
| ***H04R 7/18*** | (2006.01) |
| ***H04R 9/02*** | (2006.01) |
| ***H04R 31/00*** | (2006.01) |

(52) U.S. Cl.
CPC ..... *H04R 9/06* (2013.01); *H04R 7/18* (2013.01); *H04R 9/025* (2013.01); *H04R 31/006* (2013.01); *H04R 2400/11* (2013.01)

(58) Field of Classification Search
None
See application file for complete search history.

(56) References Cited

U.S. PATENT DOCUMENTS 2,031,775 A * 2/1936 Hinchen ..... H04R 9/045 381/405
2003/0219142 A1* 11/2003 Stompler ..... H04R 9/06 381/433

* cited by examiner

*Primary Examiner* — James Mooney
(74) *Attorney, Agent, or Firm* — GrayRobinson, P.A.; Thomas L. Kautz

(57) ABSTRACT

A loudspeaker and method of assembly according to this invention provides for simplified replacement of defective parts that can be accomplished by an unskilled worker without the use of gauges, guides, fixtures or other equipment. A moving assembly, and a combined frame and motor structure, are assembled independently of one another and then connected together, within acceptable tolerances, by a centering tee which is affixed to the moving assembly and may be easily connected to and disconnected from the motor structure.

17 Claims, 5 Drawing Sheets

LOUDSPEAKER WITH A FIELD REPLACEABLE MOVING ASSEMBLY AND METHOD OF ASSEMBLY

FIELD OF THE INVENTION

This invention relates to loudspeakers, and, more particularly, to a loudspeaker having a field replaceable moving assembly and a method of assembling the loudspeaker.

BACKGROUND OF THE INVENTION

Loudspeakers generally comprise a frame, a motor structure, a diaphragm, a lower suspension or spider and a surround or upper suspension. In one type of speaker, the motor structure includes a permanent magnet sandwiched between a top plate and a back plate, with a pole piece having a through bore centrally mounted on the back plate so that both the top plate and magnet are concentrically disposed about the pole piece. A magnetic gap is formed between the pole piece and top plate within which a voice coil is axially movable. Preferably, the voice coil consists of a hollow, cylindrical-shaped former having an inner surface and an outer surface which mounts a winding of wire.

The voice coil in speakers of the type described above is mounted within the magnetic gap by the upper and lower suspensions and the diaphragm. One end of the diaphragm is connected to the upper suspension, which, in turn, is mounted to the upper end of the frame. The lower suspension is connected at one end to the frame at a point between its upper and lower ends. The free ends of the diaphragm and lower suspension are mounted to the outer surface of the former of the voice coil and support it for axial movement within the magnetic gap. In many speaker designs, a dust cap is mounted over a central opening formed in the diaphragm so that contaminants are prevented from entering the interior of the speaker.

In the course of operation of speakers of the type described above, electrical energy is supplied to the voice coil causing it to axially move within the magnetic gap. The voice coil, diaphragm, upper suspension, lower suspension, and dust cap, if present, collectively form a "moving assembly" which reciprocates as a unit with the excursion of the voice coil.

Another common type of speaker, known as a "pot" speaker, is similar to that described above except the back plate is integrally formed with a pot wall which is concentrically disposed about a top plate and a magnet formed with aligning through bores. No pole piece is provided, but instead, the magnetic gap is formed by a radial space between the pot wall and top plate. Otherwise, pot speakers are constructed and operate in essentially the same manner as the speaker described above.

The method of fabricating traditional loudspeakers such as noted above involves a process which takes place for the most part within the confines of the frame of the speaker. Initially, the frame is secured by screws, glue or other permanent fasteners to the motor structure. The voice coil is then placed over the pole piece of the motor structure, and a centering gauge is positioned between the voice coil and pole piece. The gap between the voice coil and pole piece, as well as the height of the voice coil within the overall speaker, are set at this stage of the assembly operation with the centering gauge in place.

After the voice coil is positioned relative to the pole piece, the spider or lower suspension is slid along the outer surface of the voice coil, from the top downwardly, until the outer periphery of the lower suspension rests against a spider plateau or seat formed in the frame. When seated, the lower suspension is glued to both the outer surface of the former of the voice coil and to the spider plateau.

Many loudspeaker manufacturers purchase the upper suspension and the diaphragm as a pre-assembled unit from a third party. With the lower suspension in place, the diaphragm of the pre-assembled upper suspension—diaphragm unit is slipped over the voice coil and glued in placed on the outer surface of the former. The outer periphery of the upper suspension is then glued to an upper flange of the frame, and a gasket is attached to such upper flange outside of the upper suspension. Once all the glue has cured, the voice coil gauge is removed from between the voice coil and pole piece by pulling it upwardly through the central opening formed in the diaphragm. A dust cap is then glued to the diaphragm over its central opening.

Beginning with the pole piece of the motor structure, essentially the entire speaker consists of elements which are intended to be oriented in concentric relation to one another. The voice coil is concentric to the pole piece, and the upper suspension, lower suspension and diaphragm are concentric to the voice coil. Each of these elements is made within certain tolerances, and the tolerance "stack-up" or combined total from the voice coil radially outwardly to the upper suspension can be significant. Further, no effort is typically made to obtain fine alignment between the frame and motor structure which can add to tolerance stack-up problems, i.e., the seat or spider plateau in the frame where one end of the lower suspension is mounted, and the upper flange of the frame where the upper suspension is mounted, can be out of concentricity with respect to the pole piece of the motor structure. In most speaker designs, the total concentric tolerance stack-up must be absorbed by the upper suspension. Especially during high excursion of the voice coil, the upper suspension can deform if the tolerance stack-up is too high, causing the voice coil to "rock" or pivot within the magnetic gap. This can severely degrade the performance of the speaker.

Another problem with prior loudspeakers and their method of manufacture involves repairs and warranty work. As noted above, many of the speaker elements are permanently attached together with glue. In the event of a failure of a speaker element, a great deal of time and effort must be expended to clean the surfaces where glue has been applied before a new part can be installed. Generally, it requires skilled workers with special tools to clean part surfaces of glue, apply new glue and assemble new parts within concentricity tolerances. Moreover, expensive, specialized glues are employed in the manufacture of loudspeakers which are not available to the public. Repairs and warranty work on loudspeakers are therefore typically performed at the factory by skilled workers rather than in the field.

SUMMARY OF THE INVENTION

The loudspeaker and method of assembly of this invention is predicated on the concept of simplifying the repair or replacement of elements of a loudspeaker by employing a method of assembly, and a loudspeaker construction, in which the moving assembly of the speaker can be removed and replaced as a unit in the field by an unskilled worker without the use of special tools and without special knowledge of speaker repair. The voice coil, upper suspension, lower suspension and diaphragm comprise the "moving assembly," which, as described below, is formed as a unit outside of the speaker frame. The moving assembly is connected to a separately assembled frame and motor structure using a centering tee having a head section connected to the lower suspension and a stem section insertable within a central opening of the motor structure formed by aligning through bores in the top plate and the pole piece or magnet.

In the event of a failure of one of the elements of the moving assembly, which is typically where a problem arises, the entire moving assembly may be disconnected from the motor structure, and removed. A new moving assembly, fabricated at a factory and shipped as a unit to a retailer or off-site repair center, may be mounted to the motor structure in the field. As noted above, and described below, the centering tee and the central opening in the motor structure, allow for precise alignment of all speaker elements when the moving assembly is replaced without using gauges, guides, fixtures or other special equipment. Additionally, no dust cap is required with the speaker of this invention because the diaphragm may be formed without a central opening.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
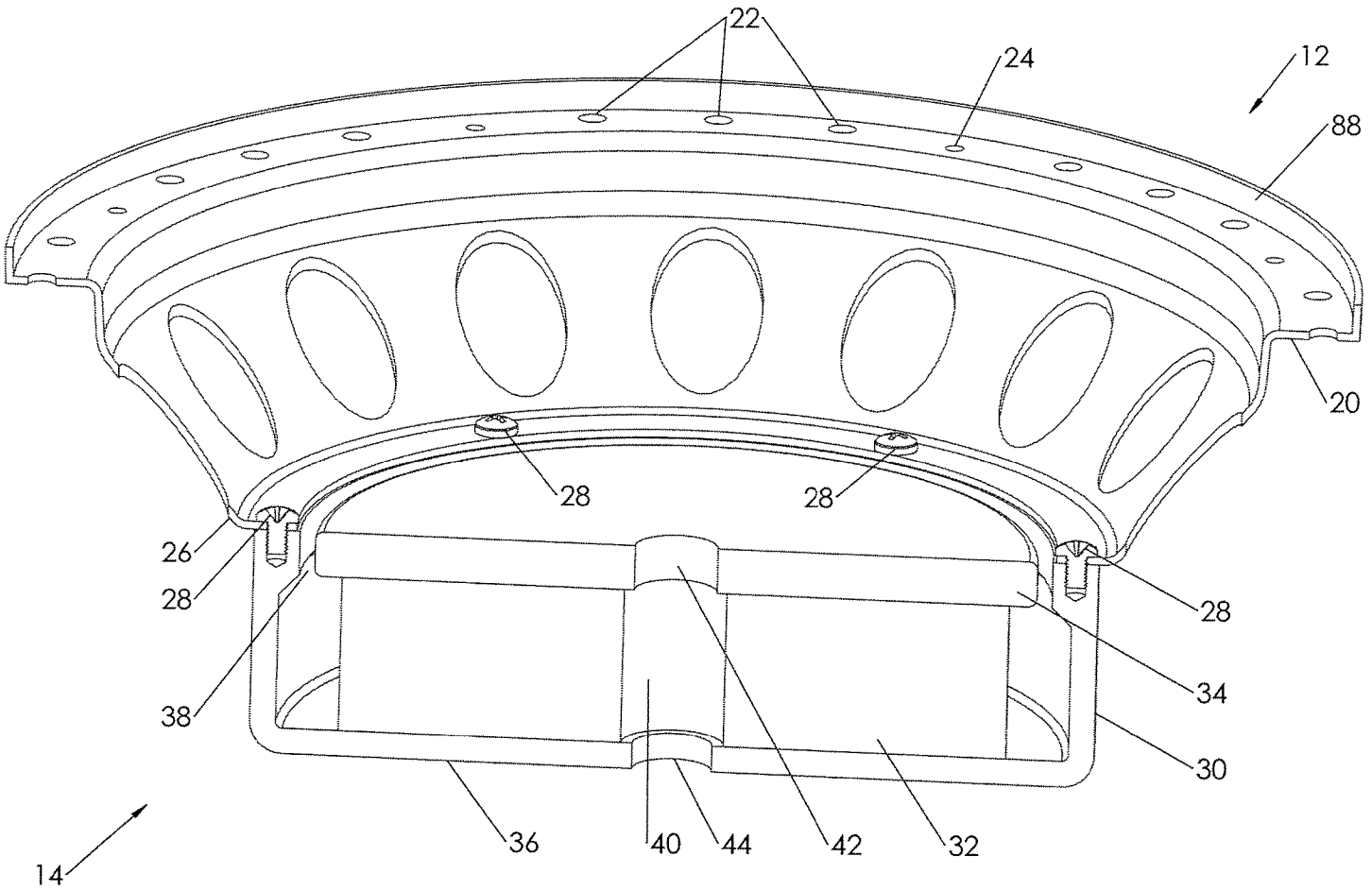
FIG. 1 is an elevational view, in partial cross section, of the assembled frame and motor structure of the speaker of this invention.

Referring to the Figs., the speaker 10 of this invention comprises a frame 12, a motor structure 14 and a moving assembly 16 including a centering tee 18. Throughout the following description, the terms "top," "bottom," "upper" and "lower" are meant to refer to directions and/or locations with the speaker 10 in the orientation shown in the Figs. The terms "inner" and "outer" refer to a radial relationship of parts or structure beginning at the longitudinal axis of the speaker 10 which, for purposes of this discussion, is considered to pass through a central opening in the motor structure 14, as described below.

The frame 12 has an upper flange 20 formed with a number of spaced, surround locator holes 22 and a number of spaced, clamp bores 24 in between groups of locator holes 22 as shown. The lower portion of the frame 12 is formed with a lower flange 26 having spaced locator holes which receive screws 28.

The speaker 10 depicted in the drawings is a "pot" type speaker in which the motor structure 14 includes a pot wall 30 concentrically disposed about a permanent magnet 32 and a top plate 34. The pot wall 30 is integrally formed with a back plate 36 upon which the magnet 32 is mounted. As shown in FIG. 1., the upwardly facing edge of the pot wall 30 has a number of holes which align with the locator holes in the lower flange 26 of frame 12. Screws 28 may be inserted through such aligning holes to connect the frame 12 and motor structure together. The top plate 34 is affixed atop the magnet 32 and radially spaced from the pot wall 30 to form the magnetic gap 38 of the speaker 10. In the presently preferred embodiment, the magnet 32 is donut-shaped with a through bore 40. The top plate 30 is formed with a through bore 42 which is concentric to the bore 40, and the back plate 36 is formed with a hole 44 in alignment with the through bores 40 and 42. Collectively, the bores 40, 42 and 44 form a central opening in the motor structure 14.

It should be understood that while a pot type speaker 10 is illustrated in the drawings this invention is equally applicable to speakers having motor structures of the type shown, for example, in U.S. Pat. No. 6,496,590, the disclosure of which is incorporated by reference in its entirety herein. As noted above, the motor structure of these types of speakers includes a top plate and a magnet concentrically disposed about a pole piece which is integrally formed with a back plate. The central opening in such motor structure comprises a through bore formed in the pole piece.

The frame 12 and motor structure 14 of the speaker 10 are illustrated in FIG. 1 in an assembled configuration, i.e. with the bottom flange 26 of the frame 12 connected by screws 28 to the upper edge of pot wall 30. The manner in which the frame 12 and motor structure 14 are connected so that they concentrically align with one another forms no part of this invention and details of same are therefore not discussed herein. For purposes of the present discussion, it is contemplated that gauges, guides and/or fixtures may be employed to mount the frame 12 and motor structure 14 together, as is well known in the industry.

Figure 2:
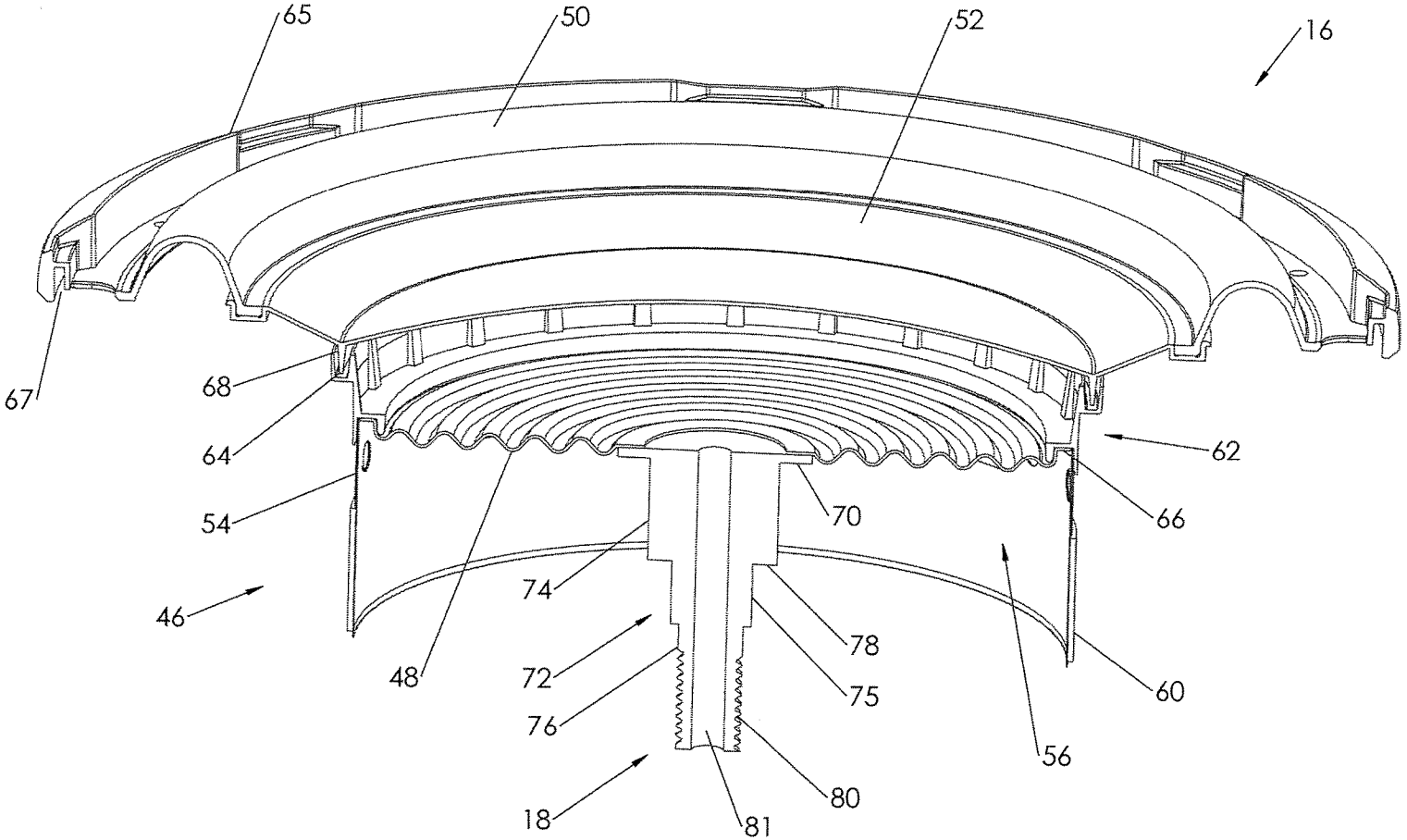
FIG. 2 is an elevational view, in partial cross section, of the assembled moving assembly of the loudspeaker herein with a centering tee connected to its lower suspension.

As best seen in FIG. 2, the moving assembly 16 of the speaker 10 of this invention comprises a voice coil 46, a lower suspension 48, an upper suspension or surround 50 and a diaphragm 52. The voice coil 46 includes a cylindrical-shaped former 54 having a hollow interior 56 and an external surface that mounts a wire winding 60.

In one preferred embodiment, an adaptor 62 is affixed to the upper end of the former 54. The adaptor 62 is a cylindrical-shaped member having an upwardly facing glue well 64 and a downwardly facing glue well 66. The inner edge of the lower suspension 48 is adhesively mounted within the downwardly facing glue well 66 of the adaptor 62 so that the lower suspension 48 is located within the hollow interior 56 of the former 54 of voice coil 46. The lower end of the diaphragm 52 is preferably formed with a foot 68 which is received and adhesively mounted within the upwardly facing glue well 64. The opposite end of the diaphragm 52 is mounted to the surround 50. As shown in the Figs., the surround 50 is integrally formed with an annular ring 65 having a downwardly facing, circumferentially extending recess 67.

The moving assembly 16 further comprises centering tee 18 which is formed with a head section 70 and a stem section 72. The head section 70 is affixed to the lower suspension 48. The stem section 72 has an upper portion 74, a smaller diameter lower portion 76 and an intermediate portion 75 located between the upper and lower portions 74, 76. A shoulder 78 is formed at the juncture of the upper portion 74 and intermediate portion 75, and at least part of the lower portion 74 is formed with external threads 80. A through bore 81 is formed in the centering tee 18 which extends along its entire length, e.g. through the head section 70 and stem section 72.

The moving assembly 16 including centering tee 18 is depicted in FIG. 2 fully assembled. The manner in which the individual components of the moving assembly 16 are connected to one another to ensure appropriate concentricity forms no part of this invention and details of same are therefore not discussed herein. Is contemplated that gauges, guides and/or fixtures may be employed to assemble the moving assembly, as is well known in the industry.

Figure 3:
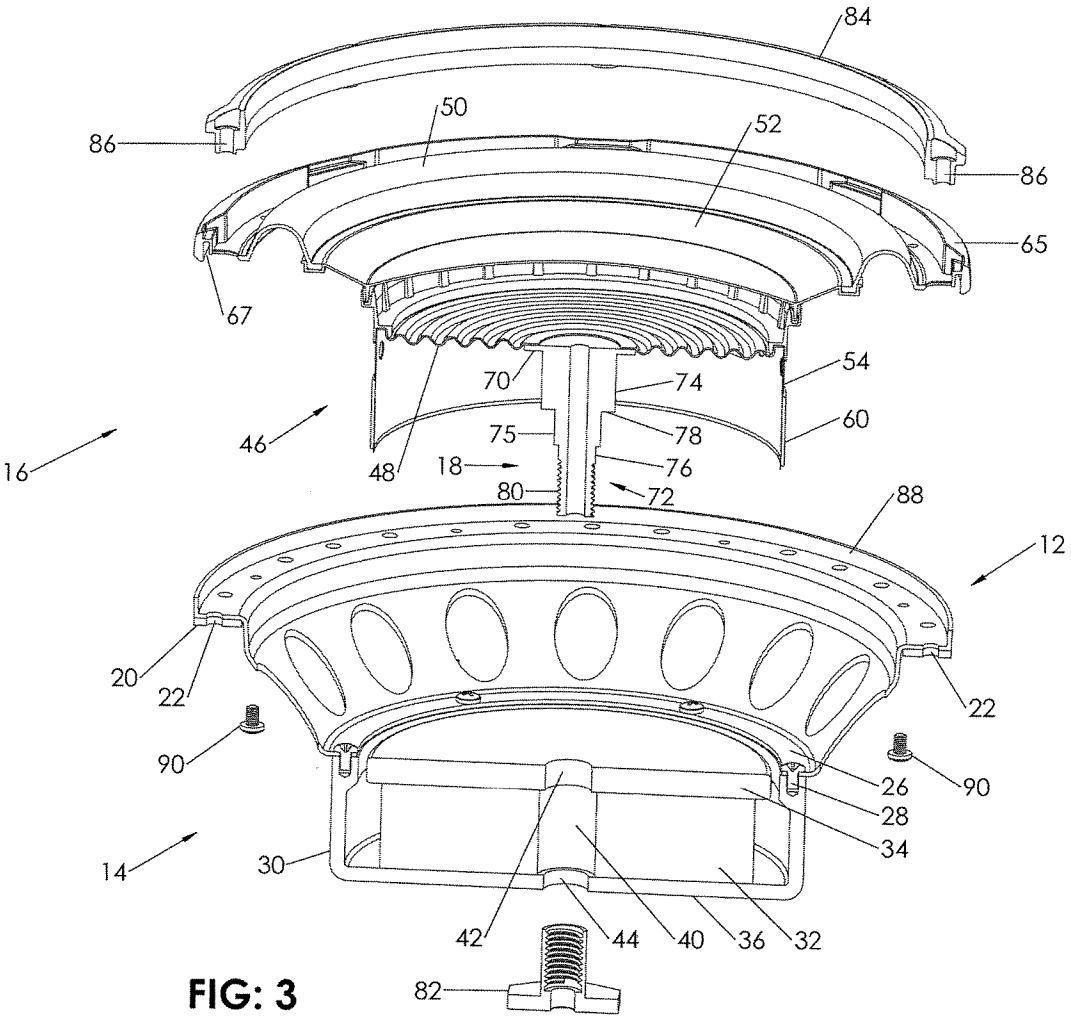
FIG. 3 is an elevational view of the initial stage of connecting the moving assembly to the assembled frame and motor structure.
Figure 4:
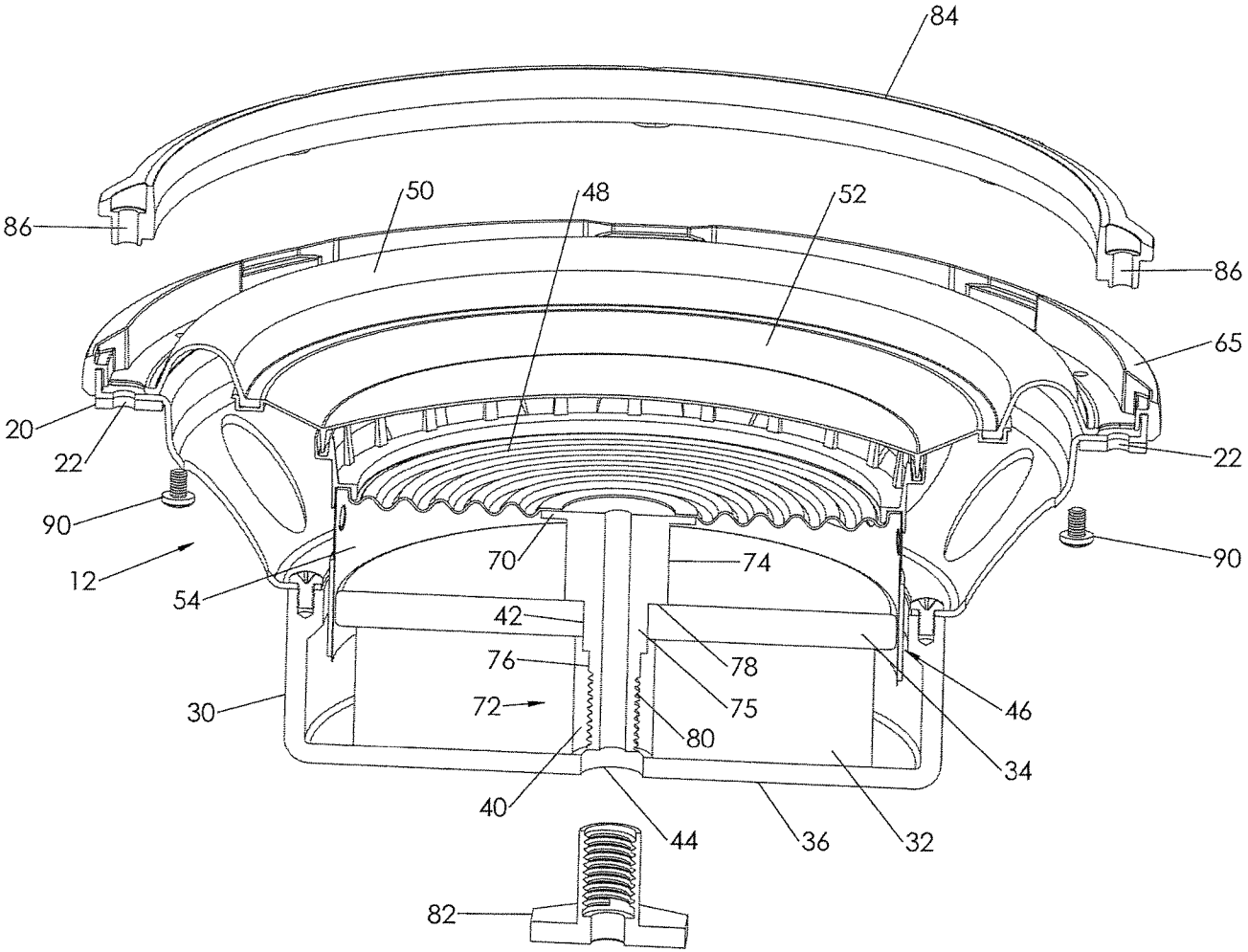
FIG. 4 is a view similar to FIG. 3 wherein the centering tee of the moving assembly is inserted into the central opening of the motor structure.
Figure 5:
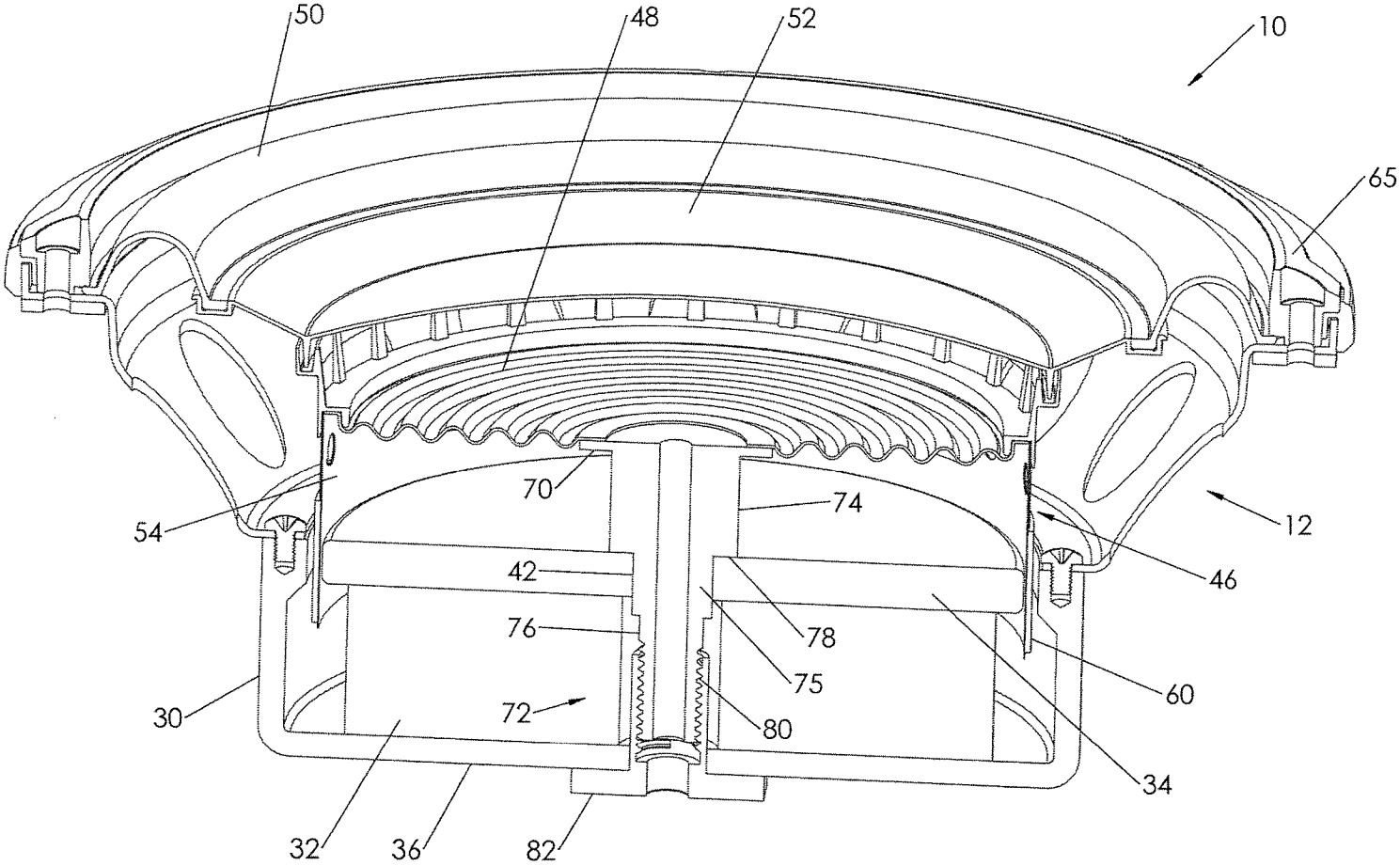
FIG. 5 is a view similar to FIG. 4 except with the moving assembly mounted to the motor structure.

Referring now to FIGS. 3-5, a fabrication operation is illustrated in which the fully assembled frame 12 and motor structure 14 are connected to the fully assembled moving assembly 16 with centering tee 18. Initially, the centering tee 18 is aligned with the central opening collectively formed in the motor structure 14 by the aligning bores 40, 42 and 44. The centering tee 18 of the moving assembly 16 is then inserted within the central opening through bores 40 and 42 such that the shoulder 78 in the stem section 72 rests atop the top plate 34 of the motor structure 14 and the intermediate portion 75 of the stem section 72 extends along the surface of top plate 34 defined by the through bore 42 therein. The lower portion 76 of stem section 72 is located within the central bore 40 in the magnet 32 of the motor structure 14. Additionally, the former 54 and its wire winding 60 extend within the magnetic gap 38 formed between the pot wall 30 and top plate 34. As seen in FIG. 5, the moving assembly 16 may be secured to the motor structure 14 by inserting a nut 82 though the hole 44 in back plate 36 and into the central bore 40 of the magnet 32 where it may be threaded onto the external threads 80 of the lower portion 76 of stem section 72 and tightened down.

The moving assembly 16 is mounted to the frame 12 by a surround ring 84 formed with a number of internally threaded bores 86. As seen in FIG. 5, when the centering tee 18 is inserted within the central opening in the moving assembly 16, a portion of the surround 50 rests atop the upper flange 20 of frame 12 and its recess 67 captures an upwardly extending rim 88 of the frame 12. The surround ring 84 may be placed atop such portion of the surround 50 so that its internally threaded bores 86 align with the clamp bores 22 in the upper flange. Screws 90 may then be inserted through the aligning bores 22, 86 and tightened down to secure the surround 50, and, hence, the moving assembly 16, to the frame 12.

It should be understood that the structure for mounting the surround 50 to the frame 12 shown in the Figs. is one presently preferred embodiment of this invention. It is contemplated that the construction taught in U.S. Pat. No. 5,949,898 for connecting the frame 12 and surround 50 could be employed in the speaker 10 of this invention, and the disclosure of such patent is hereby incorporated by reference in its entirety here.

The dimensions of stem section 72 of the centering tee 18 are precisely manufactured to ensure the moving assembly 16 is mounted in concentric relation to the motor structure 14. In particular, the diameter of the intermediate portion 75 of the stem section 72 snugly fits within the through bore 42 in the top plate 34 of motor structure 14. Further, the shoulder 78 formed between the upper and intermediate portions 74, 75 of stem section 72 engages top plate 34 so that the stem section 72 is located at the desired position within the motor structure 14 to receive the nut 82.

As noted above, one important aspect of this invention is the simplification and reduction in the cost of repairs and warranty work it provides. Prior to this invention, in the event of a failure of a speaker element a great deal of time and effort had to be expended to clean the surfaces where glue had been applied before a new part could be installed. That process typically requires skilled workers with special tools to clean part surfaces of glue, apply new glue and assemble new parts within concentricity tolerances using gauges, guides, fixtures or other special equipment. In most instances, such process would needed to be performed at the factory by skilled workers rather than in the field.

In the loudspeaker 10 and method of assembly of this invention, failure of any one of the elements of the moving assembly 16, which is typically where a problem arises, can be overcome by disconnecting the entire moving assembly 16 from the motor structure 14. This is accomplished by removing the nut 82 from the stem section 72 of the centering tee 18, removing the screws 90 from the surround ring 84 and upper flange 20, and then lifting the entire moving assembly 16 out of the motor structure 14. A new moving assembly 16, fabricated at a factory and shipped as a unit to a retailer or off-site repair center, may then mounted to the motor structure 14 in the field as described below. Such a repair can be accomplished by an unskilled worker without the use of gauges, guides, fixtures or other special equipment.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, while an adaptor 62 is illustrated in the Figs. for connecting the lower suspension 48 and diaphragm 52 to the former 54 of voice coil 46, other mounting arrangements may be used including affixing such components directly to the former 54.

Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker, comprising:

a frame;

a motor structure having a top plate formed with a through bore, said motor structure being mounted to said frame;

an assembled moving structure, comprising:

(i) a voice coil;

(ii) a lower suspension coupled to said voice coil;

(iii) an upper suspension;

(iv) a diaphragm connected between said voice coil and said upper suspension;

(v) a centering element having a first end and a second end, said first end of said centering element being permanently mounted to said lower suspension;

said assembled moving structure being mounted to said motor structure by inserting said second end of said centering element through said through bore in said motor structure and connecting a fastener to said second end.

2. The loudspeaker of claim 1 in which said centering element includes a head section and a stem section.

3. The loudspeaker of claim 2 in which said stem section of said centering element is inserted into said motor structure through said through bore in said top plate, said fastener being secured to said stem section to mount said moving assembly to said motor structure.

4. The loudspeaker of claim 3 in which said motor structure further comprises a magnet formed with a central bore in alignment with said through bore in said top plate, said central bore having a first diameter and said stem section of said centering element having second diameter which is less than said first diameter, said fastener being inserted into said central bore of said magnet and into engagement with said stem section of said centering element to secure said moving structure to said motor structure.

5. The loudspeaker of claim 2 in which said stem section of said centering element comprises an upper portion, a lower portion and an intermediate portion between said upper and lower portions, said intermediate portion of said stem section extending along and snugly fitting within said through bore in said top plate when said centering element is inserted into said motor structure.

6. The loudspeaker of claim 5 in which a shoulder is formed at the juncture of said upper portion and said intermediate portion of said stem section, said shoulder resting atop said top plate when said centering element is inserted into said motor structure.

7. The loudspeaker of claim 5 in which at least part of said lower portion of said stem section is formed with external threads, said fastener comprising a nut which is connected to said external threads.

8. A moving assembly for connection to a motor structure and a frame of a loudspeaker, the motor structure having a central opening, said moving assembly comprising:

a voice coil;

a lower suspension coupled to said voice coil;

an upper suspension;

a diaphragm connected between said voice coil and said upper suspension;

a centering element having a first end and a second end, said first end of said centering element being permanently mounted to said lower suspension, said second end of said centering element being adapted to be inserted into the central opening in the motor structure and mounted thereto.

9. The moving assembly of claim 8 in which said centering element includes a head section and a stem section.

10. The moving assembly of claim 8 in which said stem section of said centering element comprises an upper portion, a lower portion and an intermediate portion between said upper and lower portions, at least part of said lower portion being formed with external threads.

11. The moving assembly of claim 10 in which a shoulder is formed at the juncture of said upper portion and said intermediate portion of said stem section.

12. The method of assembling a loudspeaker, comprising:

(a) connecting a frame and a motor structure of the loudspeaker to one another, the motor structure having a central opening;

(b) assembling a moving assembly of the loudspeaker separate from the frame and the motor structure, said moving assembly comprising a voice coil, a lower suspension coupled to said voice coil, an upper suspension, a diaphragm connected between said voice coil and said upper suspension and a centering element having a first end fixedly permanently mounted to said lower suspension and a second end;

(c) mounting said assembled moving assembly to said motor structure by first inserting said second end of said centering element of said assembled moving assembly into said central opening of said motor structure and then securing said second end to said motor structure.

13. The method of claim 12 in which step (c) includes inserting a stem section of the centering element into said central opening in said motor structure, a portion of said stem section being formed with external threads.

14. The method of claim 13 in which step comprises attaching a nut to said external threads of said stem section to mount said moving assembly to said motor structure.

15. A loudspeaker, comprising:

a frame;

a motor structure having a top plate formed with a through bore, said motor structure being mounted to said frame;

an assembled moving structure, comprising:

(i) a voice coil;

(ii) a lower suspension coupled to said voice coil;

(iii) an upper suspension;

(iv) a diaphragm connected between said voice coil and said upper suspension;

(v) a centering element having a head section and a stem section, said head section being fixedly mounted to said lower suspension, said stem section comprising an upper portion, a lower portion and an intermediate portion located between said upper and lower portions, a shoulder being formed at the juncture of said upper portion and said intermediate portion, said stem section being inserted into said through bore of said top plate such that said shoulder rests atop said top plate and said intermediate section extends along said through bore;

a fastener connected to said lower portion of said stem section of said centering element to mount said assembled moving structure to said motor structure.

16. The loudspeaker of claim 15 in which said motor structure further comprises a magnet formed with a central bore in alignment with said through bore in said top plate, said central bore having a first diameter and said lower portion of said stem section of said centering element having a second diameter which is less than said first diameter, said fastener being inserted into said central bore of said magnet and into engagement with said lower portion of said stem section of said centering element to secure said moving structure to said motor structure.

17. The loudspeaker of claim 16 in which at least part of said lower portion of said stem section is formed with external threads, said fastener comprising a nut which is connected to said external threads.

* * * * *